US010947689B2

(12) United States Patent
Köcher

(10) Patent No.: US 10,947,689 B2
(45) Date of Patent: Mar. 16, 2021

(54) VIBRATION RAM

(71) Applicants: THYSSENKRUPP INFRASTRUCTURE GMBH, Essen (DE); ThyssenKrupp AG, Essen (DE)

(72) Inventor: Johannes Köcher, Fulda (DE)

(73) Assignees: thyssenkrupp Infrastructure GmbH, Essen (DE); thyssenkrupp AG, Essen (DE)

( * ) Notice: Subject to any disclaimer, the term of this patent is extended or adjusted under 35 U.S.C. 154(b) by 638 days.

(21) Appl. No.: 15/522,525

(22) PCT Filed: Oct. 8, 2015

(86) PCT No.: PCT/EP2015/073203
§ 371 (c)(1),
(2) Date: Apr. 27, 2017

(87) PCT Pub. No.: WO2016/071067
PCT Pub. Date: May 12, 2016

(65) Prior Publication Data

US 2017/0328022 A1 Nov. 16, 2017

(30) Foreign Application Priority Data

Nov. 7, 2014 (DE) ..... 10 2014 016 400.4

(51) Int. Cl.
*E02D 7/18* (2006.01)
*E02D 7/02* (2006.01)
(Continued)

(52) U.S. Cl.
CPC ..... *E02D 7/18* (2013.01); *E02D 7/02* (2013.01); *E02D 7/20* (2013.01); *E02D 5/226* (2013.01); *E02D 13/04* (2013.01)

(58) Field of Classification Search
CPC ..... E02D 7/02; E02D 7/18; E02D 7/20
(Continued)

(56) References Cited

U.S. PATENT DOCUMENTS 3,004,389 A * 10/1961 Muller ..... E02D 7/18 60/369
3,280,645 A * 10/1966 Roder ..... B06B 1/16 74/61

(Continued)

FOREIGN PATENT DOCUMENTS

DE 102013103722 A 10/2014

OTHER PUBLICATIONS

English translation of International Search Report issued in PCT/EP2015/073203, dated Jan. 11, 2016 (dated Jan. 22, 2016).

*Primary Examiner* — Anna K Kinsaul
*Assistant Examiner* — Daniel Jeremy Leeds
(74) *Attorney, Agent, or Firm* — thyssenkrupp North America, LLC

(57) ABSTRACT

A vibration-ram arrangement for introducing a material to be rammed into a ground may include a hydraulic apparatus for generating hydraulic pressure. The hydraulic apparatus may include an internal-combustion motor and a hydraulic pump that is drivable by the internal-combustion motor. The arrangement may further include an exciter arrangement, which is configured to be spatially separate from the hydraulic apparatus and which by way of a hydraulic line is connected to the hydraulic apparatus. The exciter arrangement may have a hydraulic motor and a rotatably mounted unbalanced mass. For driving the unbalanced mass, hydraulic liquid may be guided in a circuit comprising the hydraulic apparatus, the hydraulic line, and the hydraulic motor. The unbalanced mass is drivable by the hydraulic motor to generate vibration movements of the exciter arrangement. The arrangement may also include a support device on
(Continued)

which the hydraulic apparatus and the exciter arrangement are disposed. The present disclosure also relates to methods for operating vibration-ram arrangements and to component sets for assembling such vibration-ram arrangements.

9 Claims, 3 Drawing Sheets

(51) Int. Cl.
*E02D 7/20* (2006.01)
*E02D 5/22* (2006.01)
*E02D 13/04* (2006.01)

(58) Field of Classification Search
USPC ..... 173/38
See application file for complete search history.

(56) References Cited

U.S. PATENT DOCUMENTS 4,143,719 A * 3/1979 Furukawa ..... E02D 7/18 173/1
6,672,805 B1 * 1/2004 White ..... E02D 7/18 173/42
10,385,883 B2 * 8/2019 Spohr
2009/0007559 A1 * 1/2009 Dazin ..... B06B 1/161 60/445
2011/0240323 A1 * 10/2011 Winkes ..... B06B 1/183 173/113
2011/0243668 A1 * 10/2011 White ..... E02D 5/285 405/249
2013/0036727 A1 * 2/2013 Heichel ..... E02D 7/18 60/327
2014/0345894 A1 * 11/2014 LaCoe ..... E02D 7/06 173/1
2016/0061227 A1 3/2016 Spohr
2017/0145650 A1 * 5/2017 DeNeef ..... E02D 7/18

* cited by examiner

VIBRATION RAM

CROSS REFERENCE TO RELATED APPLICATIONS

This application is a U.S. National Stage Entry of International Patent Application Serial Number PCT/EP2015/073203, filed Oct. 8, 2015, which claims priority to German Patent Application No. DE 10 2014 016 400.4 filed Nov. 7, 2014, the entire contents of both of which are incorporated herein by reference.

FIELD

The present disclosure generally relates to vibration-ram arrangements for introducing material to be rammed into a ground, to methods of operating vibration-ram arrangements, and to components set for assembling according to requirements of vibration-ram arrangements.

BACKGROUND

Vibration-ram arrangements for underground works, having a hydraulic drive, for introducing material to be rammed into a ground are known. For example, this is a construction from an exciter cell which, coupled by way of a so-called feather yoke, is suspended from a fastening location. In most of the design embodiments that are known from the prior art, the exciter cell has at least two unbalanced masses which for generating a vertical oscillation are operated in mutually opposite rotation directions. The feather yoke functions as an oscillation damper between the exciter cell and the fastening location of the vibration-ram arrangement. The feather yoke is typically a weight which is connected to the exciter cell via springs. A crane hook can serve as a fastening location, for example.

In the case of many applications, in addition to the utilization of a vibration-ram arrangement, percussive equipment, for example hydraulic hammers, are used in order to perform an introduction of the material to be rammed to the final depth. A known example therefor is the introduction of fastening pipes for a foundation structure of an offshore construction, for example, such as a jacket or tripod construction, for example, and of so-called monopiles. The utilization of percussive equipment herein is necessary since driving outputs that cannot be provided by previously known vibration-ram arrangements are required in the case of an increasing penetration depth.

A disadvantage of utilizing a hydraulic hammer lies in the generation of noise that arises during the operation of the hydraulic hammer, and in the issues caused herein, for example in the environmental stress that is caused on account thereof.

DETAILED DESCRIPTION

Figure 1:
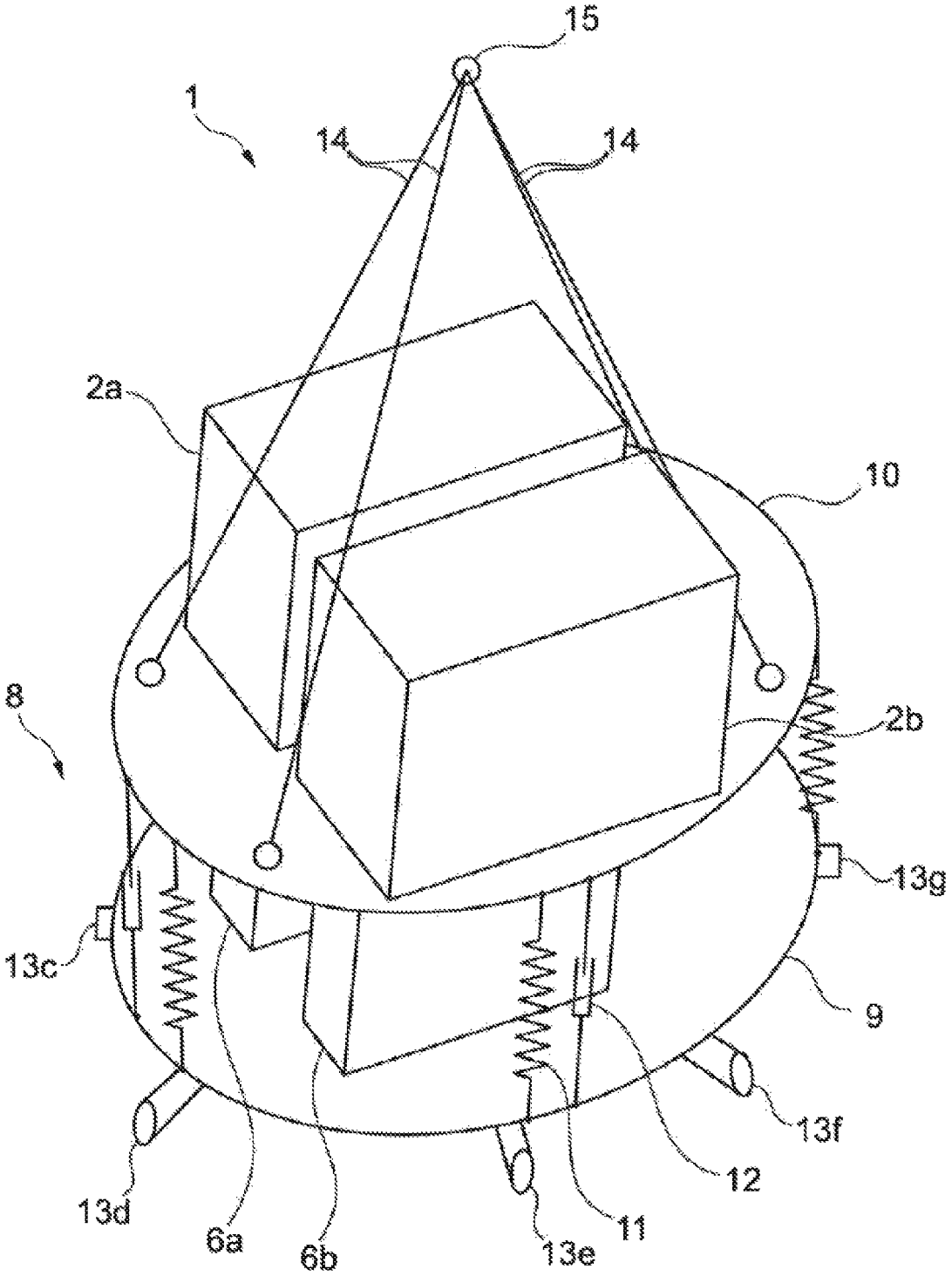
FIG. 1 is a perspective view of an example vibration-ram arrangement.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

It is therefore an object of the invention to extend the application possibilities of vibration-ram arrangements toward introducing material to be rammed of as diverse a type as possible, so as to increase the attainable depth for vibrating the material to be rammed into the ground, so as to reduce any additionally required utilization period of a hydraulic hammer or even for the latter to become dispensable.

The example object identified above may be achieved by vibration-ram arrangements, methods and component sets disclosed below. It should be understood that a wide variety of advantageous design embodiments and refinements may be derived from the following description. One or a plurality of features, from the description as well as from the figures can be combined with one or a plurality of other features from the former, so as to form further design embodiments of the present disclosure. The disclosed subject matter is to be understood to be merely exemplary, without limiting said subject matter, however.

A vibration-ram arrangement for introducing material to be rammed into a ground is proposed. The vibration-ram arrangement comprises:

- at least one hydraulic apparatus for generating a hydraulic pressure. The hydraulic apparatus has an internal-combustion engine and a hydraulic pump that is drivable by the internal-combustion engine;
- at least one exciter arrangement which is configured so as to be spatially separate from the hydraulic apparatus. The exciter arrangement by way of at least one hydraulic line is connected to the hydraulic apparatus. The exciter arrangement has at least one hydraulic motor and at least one rotatably mounted unbalanced mass. A hydraulic fluid is guided in a circuit that comprises the hydraulic apparatus, the hydraulic line, and the hydraulic motor. The unbalanced mass is drivable by means of the hydraulic motor so as to generate vibration movements of the exciter arrangement.

The vibration-ram arrangement has a support device on which at least the hydraulic apparatus and the exciter arrangement that is connected to the hydraulic apparatus are disposed.

An arrangement of the hydraulic apparatus and of the exciter arrangement on one and the same support device as a consequence has the advantage that for coupling the exciter arrangement to the hydraulic apparatus a hydraulic line having a shorter line length than in previously known arrangements suffices, the hydraulic apparatus in the latter being provided so as to be positioned separately from the vibration-ram arrangement.

In this way, the hydraulic line in embodiments that are known from the prior art is configured as a hose pack, for example, which emanating from a drive apparatus that is positioned so as to be separate and remote from the vibration-ram arrangement leads to the exciter arrangement. In particular in the case of an increased demand for drive output, this leads to a demand for one or a plurality of hydraulic lines having a high total mass. Furthermore, the application in particular in the case of offshore installation in many cases leads to comparatively large hose lengths, since the drive apparatus typically is fixedly positioned on the deck of an escort ship and cannot be set up close to the working site. Since comparatively long lengths of the hydraulic line in turn result in comparatively high pressure losses, it is necessary for a comparatively high drive output to be provided, which can be performed by providing a comparatively high number of hydraulic apparatuses and/or by providing drive apparatuses having a comparatively high output. This aspect by virtue of the high drive output that is already required in any case becomes particularly significant in the case of a high mass of the material to be rammed. Comparatively high drive outputs can likewise also become necessary by the type of the ground properties.

In the case of these increased drive outputs required in the design embodiments of the prior art and of the high masses of the hydraulic line required on account thereof, for example configured as a number of hose packs having masses of typically more than 10,000 kg, additional structural support of the hydraulic line is required, the latter being implemented by utilizing auxiliary cranes, for example.

The proposed invention, as a result of the shorter length of the hydraulic line, results inter alia in the advantage that operating the vibration-ram arrangement as compared to vibration-ram arrangements that are known from the prior art becomes less complex, since the requirement of supporting the hydraulic line, as explained at the outset, in the case of the proposed invention no longer exists. A further advantage which results from the construction of the vibration-ram arrangement according to the invention, is more time-efficient positioning of the vibration-ram arrangement for introducing material to be rammed, since by virtue of the deleted requirement of a separate support of the hydraulic line a lesser number of equipment carriers, in the ideal case even only a single equipment carrier, is required. On account thereof, a significantly more economical employment of the vibration-ram arrangement is enabled. This aspect becomes particular significant in application fields in which narrow temporal windows are available for reasons of labor legislation, meteorological causes, and/or environmental reasons, for example. An example thereof is an economical employment of the invention described for establishing offshore constructions.

As a further advantage, the required overall diameter of the hydraulic line in the case of the proposed invention is smaller since drops in the output and pressure by virtue of the shorter lines are smaller. The advantage of a significantly lower total weight of the hydraulic line, such as has been described above, is additionally amplified by this aspect.

The lower pressure loss as a result of the shorter hydraulic lines moreover leads to the vibration-ram arrangement being operable in a more energy-efficient manner. Thus, a lower output that is to be provided by the hydraulic apparatuses is required in order for the same result in terms of vibrations to be achieved.

The hydraulic apparatus can have one or a plurality of hydraulic pumps, depending on the hydraulic output required and/or on the distribution of the latter.

An exciter arrangement typically has at least two unbalanced masses. When the exciter arrangement has two unbalanced masses, and the two unbalanced masses are operated at mutually opposite revolutions, this results in a directed vibration such as is required for introducing material to be rammed.

However, design embodiments having a higher number of unbalanced masses, for example for increasing the static momentum, are quite usual. A higher static momentum herein leads directly, in the simplest case by way of a substantially proportional correlation, to a higher vibration amplitude. It can furthermore be provided that the revolution phase of one or a plurality of the unbalanced masses are mutually offset, and/or that the revolution phases of the unbalanced masses are capable of being set in relation to one another, so as to set the total static momentum of the vibration-ram arrangement.

A hydraulic hose or a bundle of hydraulic hoses can be provided as the hydraulic line, for example.

Likewise, a line of another configuration can also be provided. For example, the hydraulic line can be configured as a pipeline, wherein the pipeline is configured as a corrosion-resistant pipeline from a stainless-steel, for example.

In one design embodiment of the vibration-ram arrangement it can be provided, for example, that the support device comprises a first support element on which the exciter element is disposed, and that the support device comprises a second support element on which the hydraulic apparatus is disposed. The second support element by way of at least one spring element is coupled to the first support element.

It can likewise be provided that in addition to the coupling of the first support element to the second support element by way of a spring element, coupling is performed by way of a damper element. A damper element serves in particular as protection against setting an oscillating state in a natural frequency of the overall device, which would result in a movement that is uncontrolled and is barely convertible to a controllable state any more.

The spring element can be a coil spring, for example.

However, depending on requirements, other design embodiments of the spring element can also be provided, for example bodies from an elastomer. A design embodiment of the spring element as a body from an elastomer results in the advantage that the elastomer acts simultaneously as a spring as well as a damper element, this potentially rendering an additional arrangement of a separate damper element dispensable.

Coupling the first support element on which the exciter arrangement is disposed to the second support element on which the hydraulic apparatus is disposed results in the advantage that a vibration of the first support element can be generated for transmission to the material to be rammed. A transmission of oscillations to the second support element is avoided by the coupling by way of one spring element or a plurality of spring elements, once, following a transitional oscillating procedure, a natural frequency of the overall system of the second support element, of the spring, and of elements that are disposed on the second support element, such as the hydraulic apparatus, for example, has been exceeded.

A natural frequency of the overall system, having lower values, can be induced by way of a targeted conception of a weight of the second support element and of components that are disposed on the second support element, right up to a higher weight, and by way of a targeted conception of the spring, right up to a spring rate of a lower value, such that the natural frequency is exceeded more rapidly, the transitional oscillating procedure being able to be shortened as a result. The actual operating frequency of the exciter arrangement is expediently set in a manner sufficiently remote from the natural frequency of the overall system. To this extent, the configuration of the vibration-ram arrangement having an arrangement of a hydraulic apparatus on the second support system is advantageous also in terms of oscillation dynamics.

By way of the behavior of the second support element that, as has been explained, in the vertical direction is largely free of oscillations, advantageous positioning of the vibration-ram arrangement that is simple to handle is possible. Such positioning can be performed by suspension from a crane, for example. Suspension from a single suspension point may be provided, for example, which may be embodied as a crane hook, for example.

In one further design embodiment of the vibration-ram arrangement it can be provided, for example, that the first support element is configured as a first platform, and/or that the second support element is configured as a second platform. A configuration of the first support element as the first platform, and/or of the second support element as the second platform, to this extent results in the advantage that a particularly elegant construction and scalability of the vibration-ram arrangement is established, since a platform by virtue of planarity enables particularly flexible equipping of the support element with arrangements such as the exciter element or the hydraulic apparatus, for example.

It can be provided for a fastening device for connecting the first support element to the material to be rammed to be disposed on the first support element.

The connection can advantageously be provided as a force-fitting connection.

In one advantageous design embodiment of the vibration-ram arrangement it is provided for example that a number of at least two fastening devices for receiving a pipe end is disposed on a receptacle face of the first support element that is provided for receiving the material to be rammed.

In one design embodiment it can be provided that the fastening devices are provided for receiving a pipe end, and are disposed accordingly. For example, an arrangement of the fastening devices can be provided along a circular circumference, wherein the circular circumference advantageously corresponds to the circumference of a pipe cross section of the pipes that are provided as material to be rammed. Likewise, an adjustability of a position of one or a plurality of the fastening devices can be provided, for example an adjustability of a radial position of the fastening devices, said adjustability being able to be implemented by way of a displaceable and releasable and fixable arrangement of the fastening devices in guide rails, for example.

It can be provided, for example, that one or a plurality of the fastening devices are configured as chucks. As an example thereof, hydraulically operated chucks can be provided. Utilizing hydraulically operated chucks moreover has the advantage that by virtue of the hydraulic apparatus that is available anyway, an important component part of an infrastructure for actuating the chucks is already available.

It can thus be provided, for example, that the fastening devices are disposed on the receptacle face of the first support element along a circular circumference, in order for a pipe having a circular cross section to be received, preferably along a circular circumference of a circle with a with circular cross section of a pipe that is used in particular in establishing offshore constructions.

It can likewise be provided, for example, that the fastening devices are disposed on the receptacle face of the first support element along another arrangement; for example, an arrangement along an elliptical circumference may be provided in order for a pipe having an elliptical cross-sectional face to be fastened.

In one further design embodiment the support device can have a third support element which is rigidly connected to the second support element. By providing a third support element that is rigidly connected to the second support element, the availability of a higher receptacle capacity which can be utilized for receiving additional drive apparatuses, for example, can be effected. The rigid connection of the second support element to the third support element can be designed both as a releasable as well as a non-releasable connection, for example a materially integral connection. The rigid connection of the second support element to the third support element results in that the second support element and the third support element in terms of oscillation dynamics behave as one solid. The vibration as explained of the first support platform, having the exciter cell disposed on the first support platform, with a simultaneously desired absence of oscillation of the remaining parts of the vibration-ram arrangement is thus guaranteed.

Further support elements which are connected indirectly or directly in a rigid manner to the first support element can also be provided.

In one design embodiment of the vibration-ram assembly, in which the support device has fastening means for releasably fastening a hydraulic apparatus and/or for releasably fastening an exciter arrangement the additional advantage results that the number as well as the size dimensioning of the exciter arrangement or else of a plurality of exciter cells, like the number of as well as the size dimensioning of the hydraulic apparatus or else of a plurality of hydraulic apparatuses is selectable, for example so as to correspond to a required drive output, to the mass of the material to be rammed, and/or to the ground properties.

According to a further concept of the invention, a method for operating a vibration-ram arrangement is proposed. The method comprises the following steps:

providing a vibration-ram arrangement, fastening a material to be rammed to the vibration-ram arrangement by means of at least one fastening device that is disposed on a receptacle face of the vibration-ram arrangement (1), operating a hydraulic motor of an exciter arrangement of the vibration-ram arrangement by means of a hydraulic apparatus that is disposed on the vibration-ram arrangement, and positioning the vibration-ram arrangement by means of a single equipment carrier.

Furthermore, a configuration of a method can be provided, during which configuration at least the exciter arrangement is disposed on a first support element of a support device of the vibration-ram arrangement, and/or at least the hydraulic apparatus is disposed on a second support element of the support device.

An arrangement of the exciter arrangement on the first support element, and/or an arrangement of the hydraulic apparatus on the second element, enables targeted dimensioning of the vibration arrangement and thus flexible adapting of the vibration-ram arrangement to various ramming tasks and conditions. Thus, in the case of a planned introduction of material to be rammed that is of a considerably high mass a hydraulic apparatus having a higher drive output can be disposed on the second support element, for example. The same applies when the ground which the material to be rammed is to penetrate has a considerably high density.

The step of arranging the exciter arrangement on the first support element, and/or an arrangement of the hydraulic apparatus on the second element, can be performed in particular prior to the steps of fastening a material to be rammed to the vibration-ram arrangement, and of operating a hydraulic motor of an exciter arrangement.

In one design embodiment of the method it can be provided that, as an autonomous method step, disposing at least one spring element is performed between the first support element and the second support element. On account thereof, the advantage that a spring having a suitable spring rate can be selected depending on the natural frequency of the vibration-ram arrangement, said natural frequency depending inter alia on the total weight of the hydraulic apparatuses, can be utilized.

It can likewise be provided, for example, that a desired higher drive output is attained by way of an arrangement of more than one hydraulic apparatus.

In one further configuration of the method a third support element for receiving a further hydraulic apparatus can be rigidly connected to the second support element. On account thereof, an availability of further drive output is established.

A further independent and autonomous concept of the invention relates to a component set for assembling according to requirements a vibration-ram arrangement. Such a component set comprises at least:

- a first support element for receiving at least one exciter arrangement,
- a second support element, for receiving at least one hydraulic apparatus which by way of at least one spring element, furthermore preferably at least one damper element, is coupleable to the first support element,
- a third support element for rigidly connecting to the second support element, for receiving at least one further hydraulic apparatus.

The hydraulic apparatus and the further hydraulic apparatus by means of fastening elements are disposable on the second support element and/or disposable on the third support element, in order to provide in a scaled manner drive output for driving the hydraulic motor or the hydraulic motors. Thus, the number of the hydraulic apparatuses as well as the output of the individual hydraulic apparatus can be selected corresponding to requirements and disposed on the second support element and/or third support element.

In the case of a corresponding demand for drive output, the arrangement of further support devices which in a rigid connection is connected directly or indirectly to the first support device can also be provided.

An arrangement of the exciter arrangement, of the hydraulic apparatus, and of the further hydraulic apparatus is preferably performed by a releasable fastening, for example by way of screw connections in dedicated fastening bores of the first support element, of the second support element, and/or of the third support element.

A use of a vibration-ram arrangement according to the invention can be provided in particular for introducing material to be rammed that is configured as a foundation structure of an offshore construction, preferably for introducing a monopile, an anchor pipe for a jacket, or an anchor pipe for a tripod.

The advantages that have already been explained come to bear particularly in the case of a use of a design embodiment according to the invention of the vibration-ram arrangement in offshore applications. For example, by virtue of the winds that occur naturally in the offshore industry air cooling of the diesel engines of the hydraulic apparatus or of the hydraulic apparatuses, respectively, can be sufficient in many cases such that more complex water cooling can be dispensed with. Moreover, the advantage of the configuration of the vibration-ram arrangement in the compact construction mode explained comes to bear particularly in the case of offshore applications, since the particular requirements, for example in terms of labor law or environment protection, can be met in an extremely advantageous manner in the case of the possibility of only one equipment carrier being utilized.

In particular, a use of the vibration-ram arrangement for introducing a monopile to the final depth can be provided. Since monopiles, in contrast to some other foundation structures, at their final depth still protrude slightly from the water, an introduction to the final depth by means of the vibration-ram arrangement can be performed without the vibration-ram arrangement being submersed. This results in the particular advantage that additional percussive methods can be completely dispensed with, on account of which the vibration-ram arrangement according to the invention can be utilized in a very advantageous manner both in terms of environmental protection as well as economical aspects.

Specific design embodiments of the invention will be explained in detail hereunder with reference to the figures. The figures and the accompanying description of the resulting features are not to be considered to be limiting to the respective design embodiments but rather serve for illustrating exemplary embodiments. Furthermore, the respective features can be utilized in combination with one another as well as in combination with features of the description above for potential further refinements and improvements of the invention, especially in the case of additional design embodiments which are not illustrated.

A design embodiment of a vibration-ram arrangement 1 can be derived from FIG. 1. The vibration-ram arrangement 1 comprises a support device which has a first support element 9 and a second support element 10. The first support element 9 is configured as a first platform, wherein the first platform is configured as a circular platform. The second support element 10 is configured as a second platform which in the design embodiment shown is likewise configured as a circular plate. The second platform by way of springs 11 and damper elements 12 is coupled to the first platform, so as to guarantee decoupling of the second platform in terms of oscillation in the case of sufficiently high oscillation frequencies of the first platform. The oscillation frequencies have to be sufficiently remote from the natural frequency of the overall arrangement, so as to avoid an uncontrollable state of oscillation being attained. Two exciter arrangements 6*a*, 6*b* which in the design embodiment shown are configured as exciter cells which are fastened to that face of the first platform that faces away from that side of the first platform that is provided for receiving the material to be rammed are disposed on the first platform. Fastening devices 13*a*, 13*b*, 13*c*, 13*d*, 13*e*, 13*f*, 13*g*, and 13*h*, which are configured as hydraulically operated chucks, are fastened to the face of the first platform that is provided for receiving the material to be rammed. The fastening devices 13*a* and 13*b* are not depicted by virtue of the perspective illustration. Two hydraulic apparatuses 2*a*, 2*b* are disposed on the second platform, wherein the hydraulic apparatuses are fastened to a face of the second platform that faces away from the exciter arrangements 6*a*, 6*b*. Furthermore, suspension points, from which fastening cables 14 that converge in a common fastening point 15 which is provided for fastening the vibration-ram arrangement 1 on a fastening hook of an equipment carrier (not shown in the illustration of FIG. 1) emanate, are disposed on the second platform.

Figure 2:
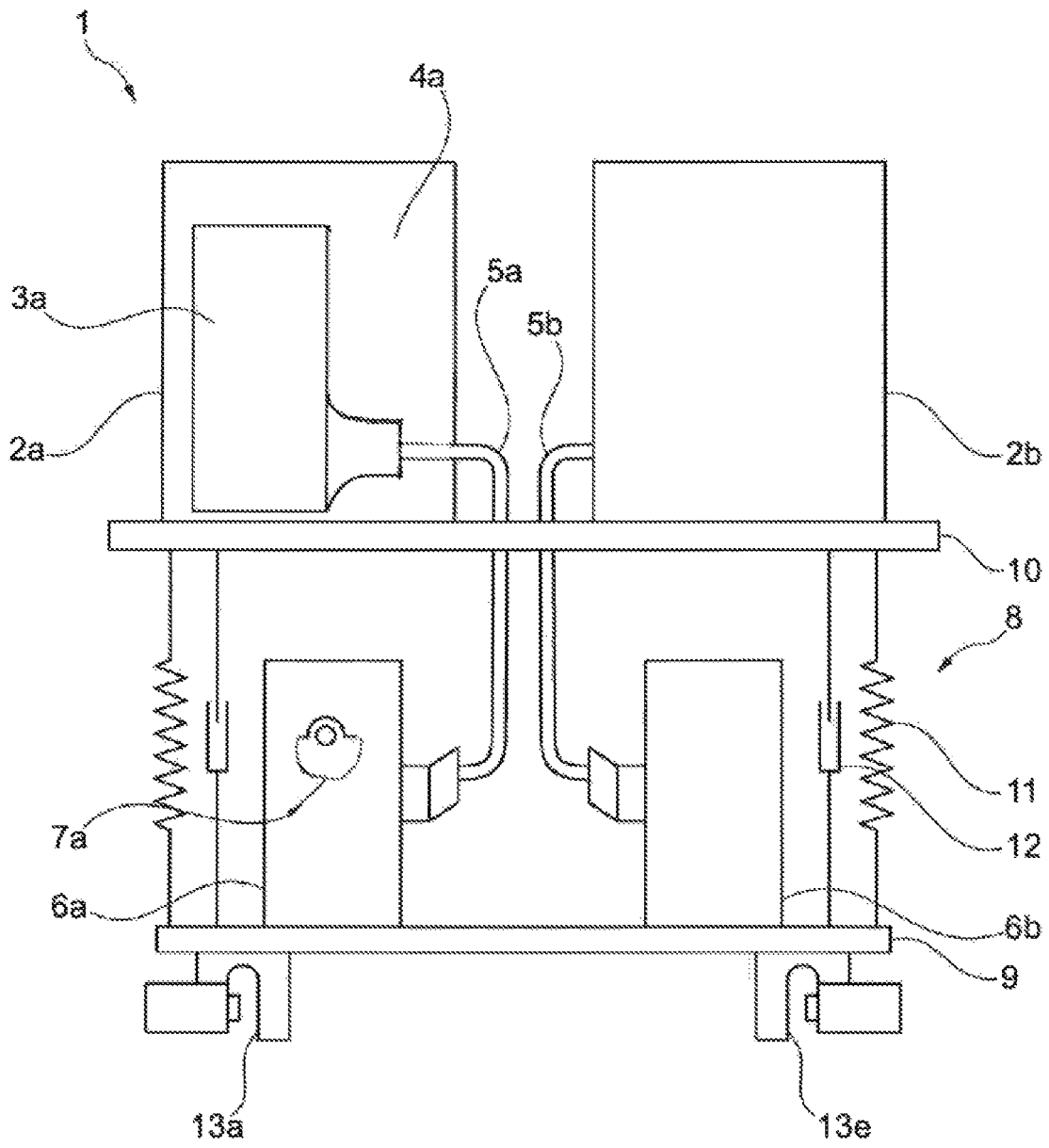
FIG. 2 is a side view of the example vibration-ram arrangement of FIG. 1.

In addition to the features that have already been illustrated in FIG. 1, the design embodiment of the hydraulic apparatuses used based on the example of the hydraulic apparatus 2*a* can be derived from the side view illustrated in FIG. 2. The hydraulic apparatus 2*a* has a hydraulic pump 4*a* which is drivable by way of the internal combustion engine 3*a*. The exciter arrangement 6*a* is connected to the hydraulic apparatus 2*a* by way of a hydraulic hose 5*a*, while the exciter arrangement 6*b* is connected to the hydraulic apparatus 2*b* by way of a hydraulic hose 5*b*. An example hydraulic motor 18 in the perspective shown is disposed behind the unbalanced mass and can be operated by way of the hydraulically circulating liquid situated in the hydraulic circuit. The hydraulic motor drives the unbalanced masses of the exciter cell 6*a*. The exciter cell 6*a* in the design embodiment shown has two unbalanced masses, wherein only one of the two unbalanced masses, specifically the unbalanced mass 7*a*, can be seen in FIG. 2. The second unbalanced mass is located on that side that is opposite the unbalanced mass 7*a*, and is therefore not visible in FIG. 2. In order for a directed vibration to be generated, the two unbalanced masses are typically operated in opposite directions.

Figure 3:
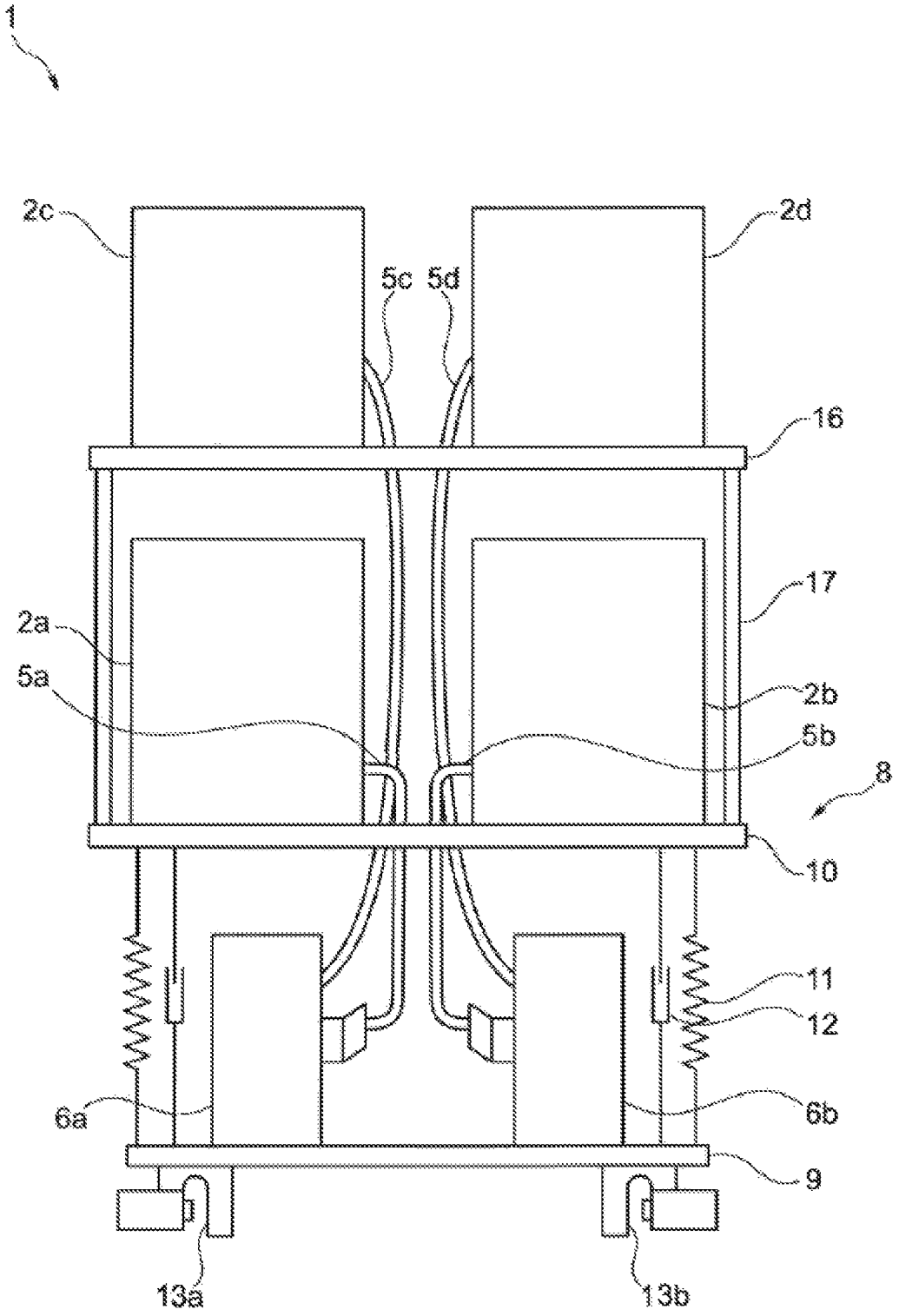
FIG. 3 is a side view of another example vibration ram arrangement.

A further design embodiment of a vibration-ram arrangement in the side view can be derived from FIG. 3. In addition to the features that could already be derived from FIG. 1 and FIG. 2, FIG. 3 has a third support element 16 which is configured as a third platform, likewise having a circular surface. Two additional hydraulic apparatuses 2*c* and 2*d* are disposed on the third platform 16, wherein the hydraulic apparatus 2*c* by way of a hydraulic line 5*c* supplies a third exciter cell which in the perspective view lies behind the first exciter cell 6*a*, the hydraulic apparatus 2*d* by way of a hydraulic line 5*d* supplying a fourth exciter cell which in the perspective view lies behind the second exciter cell 6*b*. The third platform is rigidly connected to the second platform by means of rigid connection elements 17 such that the arrangement of the second platform, of the third platform, and of the hydraulic apparatuses that are connected thereto, in terms of oscillation mechanics behave like a single body, or at least almost like a single body, respectively.

What is claimed is:

1. A vibration-ram arrangement for introducing a material to be rammed into a ground, wherein the vibration-ram arrangement comprises:

a hydraulic apparatus for generating a hydraulic pressure, wherein the hydraulic apparatus comprises an internal-combustion engine and a hydraulic pump that is drivable by the internal-combustion engine;

an exciter arrangement that is configured to be spatially separate from the hydraulic apparatus and is connected to the hydraulic apparatus by a hydraulic line, wherein hydraulic energy from the hydraulic device is transmitted to the exciter arrangement via the hydraulic line, wherein the exciter arrangement includes a hydraulic motor and a rotatably mounted unbalanced mass, wherein hydraulic fluid is guided in a circuit that comprises the hydraulic apparatus, the hydraulic line, and the hydraulic motor, wherein the rotatably mounted unbalanced mass is drivable by the hydraulic motor to generate vibration movements of the exciter arrangement; and a support device on which the hydraulic apparatus and the exciter arrangement are disposed, the support device comprising:

a first support element on which the exciter arrangement is disposed; and a second support element on which the hydraulic apparatus is disposed, wherein the second support element is coupled to the first support element by way of a spring element, wherein the first support element comprises a first platform and/or the second support element comprises a second platform.

2. The vibration-ram arrangement of claim 1 wherein the support device further comprises a third support element for receiving a second hydraulic apparatus, wherein the third support element is connected to the second support element.

3. The vibration-ram arrangement of claim 2 wherein the third support element is rigidly connected to the second support element.

4. The vibration-ram arrangement of claim 1 wherein the support device comprises fastening means for releasably fastening at least one of a hydraulic apparatus or an exciter arrangement.

5. The vibration-ram arrangement of claim 1 further comprising a fastening device disposed on the first support element, the fastening device for connecting the first support element to the material to be rammed.

6. The vibration-ram arrangement of claim 5 wherein the fastening device is a first fastening device and the vibration-ram arrangement further comprises a second fastening device, wherein the first and second fastening devices are configured as chucks for receiving a pipe end and are disposed on a receptacle face of the first support element that receives the material to be rammed.

7. The vibration-ram arrangement of claim 6 wherein the chucks are hydraulically operated chucks.

8. The vibration-ram arrangement of claim 6 wherein the pipe end that the chucks are configured to receive has a circular cross section.

9. The vibration-ram arrangement of claim 6 wherein the first and second fastening devices are disposed on the receptacle face of the first support element along a circular circumference.

* * * * *